US005878951A

United States Patent [19]

Moroi et al.

[11] Patent Number: 5,878,951

[45] Date of Patent: Mar. 9, 1999

[54] VISCOUS FLUID TYPE HEAT GENERATOR WITH HEAT-GENERATION PERFORMANCE CHANGING ABILITY

[75] Inventors: Takahiro Moroi; Takashi Ban; Shigeru Suzuki; Kiyoshi Yagi, all of Kariya, Japan

[73] Assignee: Kabushiki Kaisha Toyoda Jidoshokki Seisakusho, Kariya, Japan

[21] Appl. No.: 46,084

[22] Filed: Mar. 23, 1998

[30] Foreign Application Priority Data

Mar. 25, 1997 [JP] Japan ..... 9-072080

[51] Int. Cl.[6] ..... B60H 1/02

[52] U.S. Cl. ..... 237/12.3 R; 122/26; 126/247; 237/12.3 B

[58] Field of Search ..... 122/26; 126/247; 237/12.3 R, 12.3 B

[56] References Cited

U.S. PATENT DOCUMENTS 4,974,778 12/1990 Bertling .
4,993,377 2/1991 Itakura .

FOREIGN PATENT DOCUMENTS 2254010 10/1990 Japan .
357877 3/1991 Japan .

OTHER PUBLICATIONS

Japanese Unexamined Utility Model Publication (Kokai) No. JU–A–3–98107.

*Primary Examiner*—Mark H. Paschall
*Assistant Examiner*—Jiping Lu
*Attorney, Agent, or Firm*—Burgess, Ryan & Wayne

[57] ABSTRACT

A viscous fluid type heat generator having a heat generating chamber in which heat generation by the viscous fluid is carried out in response to the rotation of a rotor element applying a shearing action to the viscous fluid, a heat receiving chamber in which heat exchanging liquid flows to receive heat from the heat generating chamber, a heat generation control chamber containing the viscous fluid to be supplied into the heat generating chamber and receiving the viscous fluid withdrawn from the heat generating chamber. The heat generator has a fluid supplying passage for supplying the viscous fluid from the heat generation control chamber into the heat generating chamber, a fluid withdrawing passage for withdrawing the viscous fluid from the heat generating chamber into the heat generation control chamber, and a flap valve deformable to open and close one of the fluid supplying and fluid withdrawing passages in response to a change in the heating requirements. The flap valve cooperates with a valve seat having a construction to reduce surface tension of the viscous fluid acting on the flap valve to thereby promote accurate and quick valve action of the flap valve.

10 Claims, 5 Drawing Sheets

VISCOUS FLUID TYPE HEAT GENERATOR WITH HEAT-GENERATION PERFORMANCE CHANGING ABILITY

BACKGROUND OF THE INVENTION

1. Field of the Invention

The present invention generally relates to a viscous fluid type heat generator in which heat is generated by forcibly shearing a fluid having high viscosity (hereinafter referred to as a viscous fluid) confined in a chamber and the heat is transmitted to a heat exchanging liquid circulating through a heating system. More particularly, the present invention relates to a viscous fluid type heat generator provided with an ability to quickly change a heat-generation performance in response to a change in a requirement for either increasing or reducing heating to be applied to an objective heated area.

2. Description of the Related Art

Japanese Unexamined Utility Model Publication (Kokai) No.3-98107 (JU-A-3-98107) discloses a viscous fluid type heat generator adapted for being incorporated into an automobile heating system as a supplemental heat source. The viscous fluid type heat generator of JU-A-3-98107 is formed as a heat generator provided with a unit for changing a heat-generation performance. The heat generator of JU-A-3-98107 includes front and rear housings connected together to form a housing assembly in which a heat generating chamber for permitting a viscous fluid to generate heat, and a heat receiving chamber arranged adjacent to the heat generating chamber for permitting a heat exchanging liquid to receive the heat from the heat generating chamber, are formed. The heat receiving chamber in the housing assembly permits the heat exchanging liquid to flow therethrough from a liquid inlet port to a liquid outlet port formed in a portion of the housing assembly. Namely, the heat exchanging liquid is circulated through the heat receiving chamber and a separate heating circuit of the automobile heating system so as to supply the heat to the objective area, e.g., a passenger compartment of the automobile during the operation of the heating system. The heat exchanging liquid flows into and out of the heat receiving chamber through the liquid inlet port and the liquid outlet port. The heat generator of JU-A-3-98107 further includes a drive shaft rotatably supported by bearings which are seated in the front and rear housings of the housing assembly. A rotor element is mounted on the drive shaft so as to be rotated together with the drive shaft within the heat generating chamber. The inner wall surface of the heat generating chamber and the outer surfaces of the rotor element define labyrinth grooves in which the viscous fluid such as silicone oil having a chain-molecular structure is held to generate heat, in response to the rotation of the rotor element.

The heat generator of JU-A-3-98107 has such a characteristic arrangement that upper and lower housings are attached to a bottom portion of the housing assembly to form a heat generation control chamber therein. The heat generation control chamber is formed as a volume-variable chamber having a wall consisting of a membrane such as a diaphragm.

The heat generating chamber communicates with the atmosphere via a through-hole bored in an upper portion of the front and rear housings of the housing assembly, and with the heat generation control chamber via a communicating channel arranged between the heat generation control chamber and the heat generating chamber. The volume of the heat generation control chamber is adjustably changed by the movement of the diaphragm which is caused by a spring element having a predetermined spring factor or an externally supplied signal such as a pressure signal supplied from an engine manifold of an automobile.

When the drive shaft of the heat generator of JU-A-3-98107 incorporated in an automobile heating system is driven by an automobile engine, the rotor element is rotated within the heat generating chamber, so that heat is generated by the viscous fluid to which a shearing force is applied between the inner wall surface of the heat generating chamber and the outer surfaces of the rotor element. The heat generated by the viscous fluid is transmitted from the heat generating chamber to the heat exchanging liquid, i.e., engine-cooling water circulating through the heating system and carried by the water to a heating circuit of the heating system to warm an objective heated area such as a passenger compartment.

When it is detected that the objective area is excessively heated with respect to a reference temperature value predetermined for that area, through the detection of the temperature of the viscous fluid, the diaphragm of the heat generation control chamber is moved in response to a vacuum pressure signal supplied from the engine manifold to increase the volume of the heat generation control chamber. Accordingly, the viscous fluid is withdrawn from the heat generating chamber into the heat generation control chamber to reduce generation of heat by the viscous fluid between the inner wall surface of the heat generating chamber and the outer surfaces of the rotor element. Therefore, the heat generation performance can be reduced, i.e., the provision of heat to the objective heated area is reduced.

When it is detected that heating of the objective heated area is excessively weak with respect to the predetermined reference temperature value, through the detection of the temperature of the viscous fluid, the diaphragm of the heat generation control chamber is moved by the pressure signal and by the spring force of the spring element to reduce the volume of the heat generation control chamber. Therefore, the viscous fluid contained in the heat generation control chamber is supplied into the heat generating chamber so as to increase heat generation by the viscous fluid between the inner wall surface of the heat generating chamber and the outer surfaces of the rotor element. As a result, the heat generation performance can be increased, i.e., the provision of heat to the objective heated area is increased.

Nevertheless, in the viscous fluid type heat generator having variable heat generation performance, disclosed in the JU-A-3-98107, when the viscous fluid is withdrawn from the heat generating chamber into the heat generation control chamber, atmospheric air is introduced from the through-hole of the housing assembly into the heat generating chamber so as to remove a vacuum occurring in the heat generating chamber due to the withdrawal of the viscous fluid therefrom. Thus, the viscous fluid must come into contact with the atmospheric air many times when the change of the heat generation performance occurs, and is oxidized. Therefore, a gradual degradation of the heat generating characteristics of the viscous fluid occurs. Further, the above-mentioned through-hole formed in the housing assembly permits a certain amount of moisture to enter from the atmosphere into the heat generating chamber of the heat generator, and accordingly, the viscous fluid is adversely affected by the moisture within the heat generating chamber after a long operation time of the heat generator, so that the heat generating characteristics of the viscous fluid must be again degraded.

Further, the viscous fluid type heat generator of JU-A-3-98107 is provided with internally neither a mechanism nor a means for conducting an appropriate replacement of the viscous fluid between the heat generating chamber and the heat generation control chamber. Thus, when the drive shaft is continuously rotated at a high speed without withdrawing the viscous fluid from the heat generating chamber into the heat generating control chamber, the viscous fluid confined in the heat generating chamber is continuously subjected to a shearing action by the rotor element and heated to an extremely high temperature at which the physical properties of the viscous fluid are degraded, reducing the heat generation performance.

U.S. Pat. No. 4,974,778, and the corresponding German laid-open publication DE-3832966 disclose a different type of heating system for a vehicle with a liquid-cooled internal combustion engine, which includes a viscous fluid type heating unit. The viscous fluid type heating unit of U.S. Pat. No. '778 includes a housing defining a heat generating chamber or a working chamber having a through-opening, and a heat generation control chamber or a viscous fluid supply chamber communicating with the heat generating chamber via the through-opening. The through-opening between the heat generating chamber and the heat generation control chamber is closed and opened by a spring-operated closing means, and accordingly, the degradation of the viscous fluid can be avoided even after either the extended use of the heating unit or a high speed continuous operation of the heating unit. The spring-operated closing means of the heating unit of U.S. Pat. No. '778 is provided with a lever member having one pivotally supported end and the other free end to which a closing member is attached to be able to close the through-opening, a resilient member for constantly urging the closing member toward the through-opening via the lever member, and a leaf spring made of a bimetallic material deformable in response to a change in the temperature of the viscous fluid and attached to the lever member so as to be deformed against the spring force of the resilient member. Thus, a thermal deformation of the bimetallic leaf spring causes the lever member to pivotally move to cause the closing member held by the lever member to be moved toward and away from the through-opening between the heat generating chamber and the heat generation control chamber against the spring force of the resilient member. However, the employment of a plurality of the operating members for constituting the closing means to close the through-opening between the heat generating chamber and the heat generation control chamber causes the unfavorable operating condition that a deformation of the bimetallic leaf spring due to a change in the temperature of the viscous fluid within the heat generation control chamber does not cause an immediate movement of the closing member toward and away from the through-opening. Further, a controlling operating of the closing means might become inaccurate due to total manufacturing tolerances of all of the plurality of operating members of the closing means. Namely, the performance of the closing means of the through-opening of the viscous fluid type heating unit of U.S. Pat. No. '778 is insufficient for controlling the heat generation performance of the viscous fluid type heating unit quickly and accurately. Further, the use of the plurality of operating members to constitute the closing means of the through-opening between the heat generating chamber and the heat generation control chamber causes an increase in not only the manufacturing cost of the closing means but also a difficulty in assembling the closing means in the heating unit of the heating system. Moreover, the closing means of the viscous fluid type heating unit of U.S. Pat. No. '778 has a relatively large size requiring a large volume of the heat generation control chamber to receive therein the closing means. As a result, the mounting of the viscous fluid type heating unit in a vehicle at a position suitable for receiving drive power from the vehicle internal combustion engine must be difficult.

By taking into consideration the above-mentioned various defects of the viscous fluid type heating units according to the prior art, the present inventors have sought measures for solving the defects of the viscous fluid type heating unit according to the prior art, and have considered to employ a flap valve capable of deforming itself in order to open and close a through-opening arranged between a heat generating chamber and a heat generation control chamber of a viscous fluid type heat generator having a variable heat generation performance. Nevertheless, it was confirmed that an arrangement of the flap valve in the heat generation control chamber to control the opening and closing of the through-opening between the heat generating chamber and the heat generation control chamber is still insufficient for obtaining accurate and rapid response performance in controlling the heat generation performance of the viscous fluid type heat generator. Namely, when a flap valve was disposed so as to openably close an end opening of a fluid withdrawing passage, a large contact area appeared between the flap valve and a contacting area surrounding the end opening of the fluid withdrawing passage. This is because the flap valve is an element usually having a flat contacting face, and the end opening of the fluid withdrawing passage is usually formed to have a flat peripheral region surrounding thereof. Thus, the flap valve cannot easily move from its closing position to its opening position due to a large surface tension of the viscous fluid acting between the large contacting face of the flap valve and the large contacting area surrounding the end opening of the fluid withdrawing passage. This unfavorable condition of the flap valve occurs irrespective of a difference in the type of the flap valve between a reed type flap valve which is deformable in response to a change in a pressure prevailing in the heat generating chamber and a thermally operative bimetallic flap valve.

Further, it was also confirmed that when a flap valve is arranged to openably close an end opening of a fluid supply passage, an identical unfavorable operating condition appears in the case where the flap valve is a thermo-sensitive bimetallic flap valve. Thus, the employment of the flap valves for controlling the opening and closing the end openings of the fluid supply and withdrawing passages of the viscous fluid type heat generator was insufficient for obtaining an accurate and quick controlling of the heat generation performance of the heat generator.

SUMMARY OF THE INVENTION

Therefore, an object of the present invention is to provide a viscous fluid type heat generator having a variable heat generation performance, capable of obviating all defects encountered by the conventional viscous fluid type heat generator having a variable heat generation performance.

Another object of the present invention is to provide a viscous fluid type heat generator having a variable heat generation performance capable of maintaining a good heat generation performance after not only a long use thereof but also a continuous operation thereof at a high operating speed.

A further object of the present invention is to provide a viscous fluid type heat generator having a variable heat generation performance able to conduct an accurate and quick control of the heat generation performance in response to a change in heat generating requirements.

In accordance with the present invention, there is provided a variable heat-generation-performance, viscous-fluid-type heat generator comprising:

a housing assembly defining therein a fluid-tight heat generating chamber in which heat is generated, and a heat receiving chamber arranged adjacent to said fluid-tight heat generating chamber to permit a heat exchanging fluid to circulate therethrough to thereby receive heat from the fluid-tight heat generating chamber, the fluid-tight heat generating chamber having inner wall surfaces thereof;

a drive shaft supported by the housing assembly to be rotatable about an axis of rotation thereof, the drive shaft being operatively connected to an external rotation-drive source;

a rotor element mounted to be rotationally driven by the drive shaft for rotation together therewith within said fluid-tight heat generating chamber, the rotor element having outer faces confronting the inner wall surfaces of the fluid-tight heat generating chamber via a predetermined gap;

a viscous fluid, filling the gap between the inner wall surfaces of the fluid-tight heat generating chamber and the outer faces of the rotor element, for heat generation during the rotation of the rotor element, wherein the housing assembly further comprises:

a heat generation control chamber formed therein to have a given amount of volume for containing the viscous fluid therein;

a fluid withdrawing passage for passing the viscous fluid from the heat generating chamber toward the heat generation control chamber to permit at least a part of the viscous fluid in the heat generating chamber to be withdrawn into the heat generation control chamber for reducing the heat generation performance of the viscous fluid type heat generator, the fluid withdrawing passage having opposite open ends thereof;

a fluid supplying passage for passing the viscous fluid from the heat generation control chamber toward the heat generating chamber to permit at least a part of the viscous fluid in the heat generation control chamber to be supplied into the heat generating chamber for increasing the heat generation performance of the viscous fluid type heat generator, the fluid supplying passage having opposite open ends;

a flap valve means for closing one of the opposite open ends of at least one of the fluid withdrawing and supplying passages, the flap valve means being arranged to be in contact with a face portion of the housing assembly extending around one of the opposite open ends of at least one of the fluid withdrawing and supplying passages when the flap valve means is in a closing position thereof, and being deformable to make a self-movement thereof moving from the closing position thereof; and, a valve action correcting arrangement for promoting a separation of the flap valve means from the face portion of the housing assembly extending around one of the opposite open ends of at least one of the fluid withdrawing and supplying passages when the flap valve means moves from the closing position thereof.

Preferably, the valve action correcting arrangement comprises a contacting area reducing construction arranged between the face portion of the housing assembly extending around one of the opposite open ends of at least one of the fluid withdrawing and supplying passages and the flap valve means so as to reduce a contacting area of the flap valve means with the face portion of the housing assembly.

The contacting area reducing construction may comprise a circularly extending recess formed in the face portion of the housing assembly to arrange a substantially circular valve seat surrounding the open end of at least one of the fluid withdrawing and supplying passages, which is closed and opened by the flap valve means, the circularly extending recess being arranged to not be in contact with the flap valve means when the flap valve means is in its closing position. Typically, the circular valve seat of the housing assembly of the viscous fluid type heat generator incorporated in a vehicle heating system is formed to have a width of 0.2 mm through 1.0 mm. When the width of the circular valve seat is less than 0.2 mm, the seal between the flap valve means and the valve seat becomes incomplete. On the other hand, when the width of the circular valve seat is larger than 1.0 mm, the surface tension of the viscous fluid attached to the valve seat becomes excessive. The circular recess is formed in the face portion of the housing assembly to be preferably equal to or larger than 0.05 mm deep to effectively reduce the surface tension of the viscous fluid.

Alternatively, the contacting area reducing construction may comprise a substantially circular valve seat formed by a circularly extending raised portion arranged in the face portion of the housing assembly.

On the contrary, the circularly extending raised portion of the contacting area reducing construction may be formed in a portion of the flap valve means per se so that only the raised portion of the flap valve means comes into contact with a flat face portion of the housing assembly to close the open end of either the fluid supplying passage or the fluid withdrawing passage.

Further, the contacting area reducing construction may comprise a substantially circular valve seat surrounding the open end of at least one of the fluid withdrawing and supplying passages, and a substantially circular surface-roughened area extending around the circular valve seat, the circular valve seat and the circular surface-roughened area being formed in the face portion of the housing assembly.

The viscous fluid type heat generator may further comprise a subsidiary fluid supplying passage for providing a predetermined constant fluid communication between the heat generation control chamber and the heat generating chamber, the subsidiary fluid supplying passage constantly supplying a given amount of viscous fluid from the heat generation control chamber to the heat generating chamber.

The viscous fluid type heat generator may further comprise a subsidiary fluid withdrawing passage for providing a predetermined constant fluid communication between the heat generation control chamber and the heat generating chamber, the subsidiary fluid withdrawing passage constantly withdrawing a given amount of viscous fluid from the heat generating chamber to the heat generation control chamber.

In the above-described variable heat-generation-performance, viscous fluid type heat generator, the heat generation control chamber is arranged to have a given volume for containing the viscous fluid therein, and fluidly communicates with the heat generating chamber via the fluid supplying passage and the fluid withdrawing passage. Therefore, when the fluid supplying passage is kept open to provide a fluid communication between the heat generating and heat generation control chambers, the viscous fluid can be supplied from the heat generation control chamber into the heat generating chamber via the fluid supplying passage. On the other hand, when the fluid withdrawing passage is kept open to provide a fluid communication between the heat generating and heat generation control chambers, the viscous fluid can be withdrawn from the heat generating chamber into the heat generation control chamber via the fluid withdrawing passage. Accordingly, when the deformable flap valve means is used for controlling the opening and closing of either the fluid supplying passage or the fluid withdrawing passage, heat generation by the viscous fluid held between the inner wall surface of the heat generating chamber and the outer surface of the rotor element within the heat generating chamber can be adjustably controlled. Namely, an increase or a reduction in the heat generation performance of the viscous fluid type heat generator can be adjustably achieved by adjustably controlling the supply of the viscous fluid into the heat generating chamber or the withdrawal of the viscous fluid from the heat generating chamber.

At this stage, in the described viscous fluid type heat generator, during the withdrawing of the viscous fluid from the heat generating chamber into the heat generation control chamber, and also during the supplying of the viscous fluid from the heat generation control chamber to the heat generating chamber, the total internal volume of the heat generating chamber, the fluid withdrawing passage, the fluid supplying passage, and the heat generation control chamber of the housing assembly is unchanged, and accordingly, the flow or movement of the viscous fluid does not generate a vacuum portion within the housing assembly. Thus, no fresh air is introduced into the afore-mentioned heat generating chamber, the fluid withdrawing passage, the fluid supplying passage, and the heat generation control chamber, and accordingly, the viscous fluid filled in the heat generator does not come into contact with fresh air. Thus, degradation of the heat generating characteristics of the viscous fluid can be prevented. In addition, since atmospheric moisture is not permitted to enter into the housing assembly, the viscous fluid is not adversely affected by the moisture. Therefore, the heat generating characteristics of the viscous fluid can remain constant over a long operation life of the heat generator.

Further, in the described viscous fluid type heat generator, even if the drive shaft is continuously rotated at a high speed, the viscous fluid in the heat generating chamber can be replaced with the viscous fluid stored in the heat generation control chamber through the fluid supplying passage and the fluid withdrawing passage. Therefore, the viscous fluid within the heat generating chamber is not heated up to an extreme high temperature, above the temperature limit for durability. Thus, degradation of the viscous fluid can be prevented. Accordingly, the heat generator can maintain its heat generation performance after the continuous high speed operation thereof.

In the described viscous fluid type heat generator, a flap valve means deformable to move itself to directly open and close the open end of either the fluid supplying passage or the fluid withdrawing passage is used. The deformable flap valve means is preferably constituted by a thermally deformable element, either a reed valve element or a bimetallic type valve element arranged within the heat generation control chamber. Thus, the opening and closing of the fluid supplying passage or the fluid withdrawing passage occurs immediately in response to deforming of the flap valve means. Accordingly, a quick control of the opening and closing of either the fluid supplying passage or the fluid withdrawing passage can be achieved. In addition, by initially adjusting the deforming characteristics of the flap valve means, it is possible to minutely change the amount of opening of the fluid supplying passage or the fluid withdrawing passage. As a result, the use of the flap valve means for controlling fluid communication between the heat generating chamber and the heat generation control chamber makes it possible to produce viscous fluid type heat generators having a variety of controlling characteristics of the heat generation performance thereof.

The flap valve means can be assembled in the viscous fluid type heat generator by merely fixing an end of the flap valve means to a predetermined position of the housing assembly by using a screw bolt. Namely, the assembly of the flap valve means does not result in an increase in the manufacturing cost of the viscous fluid type heat generator. Moreover, since the flap valve means is usually a small mechanical element, it is possible to design the size of the heat generation control chamber in which the flap valve means is received to be as small as possible. Accordingly, the entire size of the variable heat-generation-performance, viscous-fluid-type heat generator may be reduced to enable the heat generator to be mounted in a narrow engine compartment of an automobile or a vehicle.

Further, since the flap valve means of the described viscous fluid type heat generator is arranged to have the smallest possible contact area with the face portion of the housing assembly surrounding the open end of either the fluid supplying passage or the fluid withdrawing passage, the surface tension of the viscous fluid acting in the contacting area of the flap valve means and the face portion surrounding the open end of either the fluid supplying passage or the fluid withdrawing passage can be reduced. Thus, the flap valve means can easily move its closing position to its opening position even if the flap valve means is constituted by either a reed valve element or a bimetallic type valve element. Thus, the opening and closing operation of the deformable flap valve means is implemented so as to achieve a timely control of the heat generation performance of the viscous fluid type heat generator. Therefore, the described variable heat-generation-performance, viscous-fluid-type heat generator can be a heat generator suitable for incorporation in a vehicle heating system, and able to exhibit a reliable heat generation performance over a long operation life and after long high speed operation. Also, the heat generator can control the heat generation performance quickly in response to a change in a heating requirement from the vehicle heating system.

Further, in the described heat generator, when either the subsidiary fluid supplying passage or the subsidiary fluid withdrawing passage is arranged between the heat generating chamber and the heat generation control chamber, it is possible to cause a constant circulatory flow of the viscous fluid through the heat generating chamber and the heat generation control chamber. Thus, the viscous fluid held in the heat generating chamber can be constantly replaced, so that the degradation of the viscous fluid due to excessive heating can be effectively avoided.

BRIEF DESCRIPTION OF THE DRAWINGS

The above, and other objects, features, and advantages of the present invention will be made more apparent from the ensuing description of the preferred embodiments of the present invention with reference to the accompanying drawings wherein.

DESCRIPTION OF THE PREFERRED EMBODIMENTS

Figure 1:
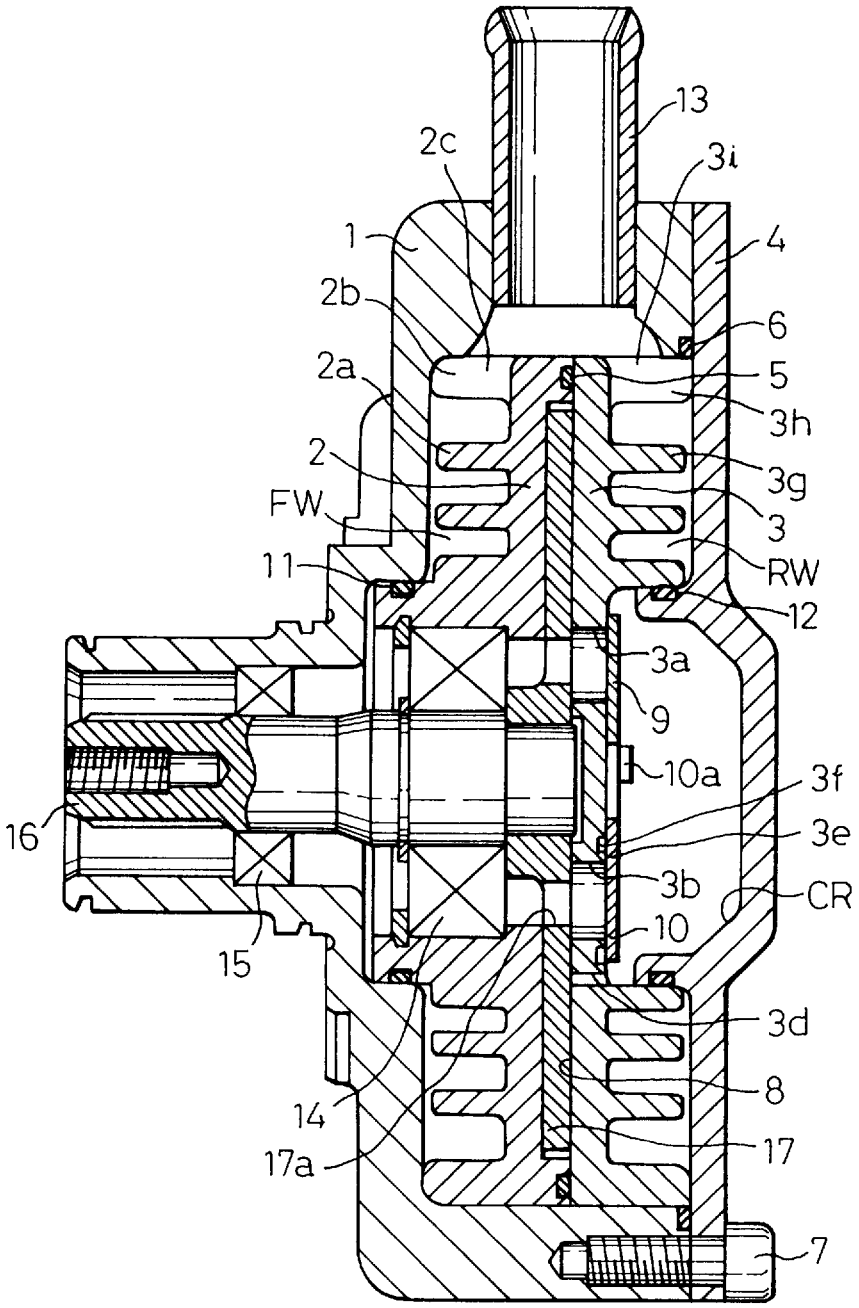
FIG. 1 is a cross-sectional view of a variable heat-generation-performance, viscous-fluid-type heat generator according to an embodiment of the present invention.

FIG. 1 illustrates a variable heat-generation-performance, viscous-fluid-type heat generator according to the first embodiment of the present invention, which is positioned to be mounted in a mounting region, e.g., an engine compartment of a vehicle.

Referring to FIGS. 1 through FIG. 3B, the viscous-fluid-type heat generator according to the first embodiment includes a housing assembly provided with a front housing body 1, a front plate member 2, a rear plate member 3, and a rear housing body 4. The front plate member 2 and the rear plate member 3 are axially combined together via a sealing element made of an O-ring 5 to define a later-described heat generating chamber, and are accommodated in the interior of the front housing body 1, and the rear open end of the front housing body 1 is closed by the rear plate 4 fixed to the front housing body 1 by means of a plurality of screw bolts 7.

The front plate element 2 is provided with a circular recess formed in a rear end face thereof and cooperates with a front end face of the rear plate element 3 so as to define a heat generating chamber 8 in which heat generation by a viscous fluid, typically a silicone oil, occurs when the viscous fluid is subjected to a shearing action by the rotation of a later-described rotor element 13.

Figure 2:
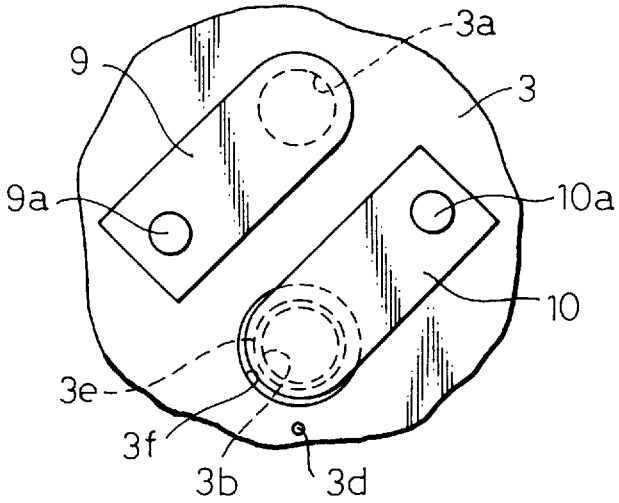
FIG. 2 is a partial view of a rear plate member incorporated in the heat generator of FIG. 1, illustrating an arrangement of flap valves, viewed from the heat generating control chamber of the heat generator.

As shown in FIG. 2 in addition to FIG. 1, the rear plate member 3 is provided with a through-bore 3*a* formed as a later-described fluid withdrawing passage. The through-bore 3*a* is arranged so as to open into the heat generating chamber 8 at an upper position of a radially central area extending around the center of the heat generating chamber 8. The rear plate member 3 is also provided with a through-bore 3*b* formed as a later-described fluid supplying passage. The through-bore 3*b* is arranged so as to open into the heat generating chamber 8 at a lower position of the radially central area of the heat generating chamber 8. The rear plate member 3 is further provided with a through-hole 3*d* formed as a subsidiary fluid supplying passage. The through-hole 3*d* is arranged so as to be positioned below the above-mentioned through-bore 3*b* formed as the fluid supplying passage.

The through-bores 3*a* and 3*b* are formed to have a substantially identical bore diameter, and the through-hole 3*d* is formed to have a bore diameter sufficiently smaller than that of the through-bores 3*a* and 3*b*.

The through-bore 3*a* formed as the fluid withdrawing passage has opposite open ends opening toward the heat generating chamber 8 and a later described heat generation control chamber CR. The open end of the through-bore 3*a* opening toward the heat generation control chamber CR is closed by a flap valve 9 made of deformable material as best shown in FIG. 2. The flap valve 9 is attached to the rear plate member 3 by means of a screw bolt 9*a*.

Figure 3A:
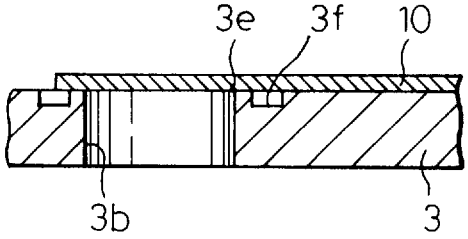
FIG. 3A is a partial and cross-sectional view of the flap valve and the rear plate element of FIG. 2, illustrating a closing position of the flap valve.
Figure 3B:
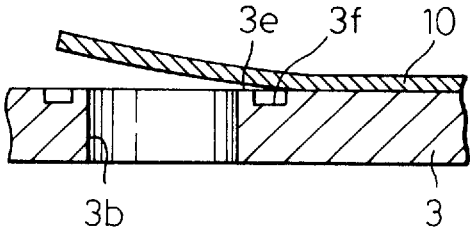
FIG. 3B is the same view as FIG. 3A, illustrating an opening position of the flap valve.

The through-bore 3*b* formed as the fluid supplying passage has opposite open ends opening toward the heat generating chamber 8 and the heat generation control chamber CR. The open end of the through-bore 3*b* opening toward the heat generation control chamber CR is closed by a flap valve 10 made of a deformable material as illustrated in FIGS. 2, 3A and 3B. The flap valve 10 is attached to the rear plate member 3 by means of a screw bolt 9*a*.

In the described first embodiment of the present invention, the deformable flap valves 9 and 10 are provided as self-moving flat valve members made of bimetallic material, respectively, and moving between its closing and opening positions in response to a deformation of these valves 9 and 10 per se, which is caused by a change in temperature in the viscous fluid (i.e., a silicone oil) held in both heat generating chamber 8 and heat generation control chamber CR. It should be noted that although the flap valve 9 is arranged to move from its closing position toward its opening position in response to an increase in the temperature of the silicone oil, the flap valve 10 is arranged to move from its opening position toward its closing position in response to an increase in the temperature of the silicone oil. The open end of the through-bore 3*b* (i.e., the fluid supplying passage) formed in the rear plate 3 is surrounded by a circular valve seat 3*e* which is in turn surrounded by a circular recess 3*f*. Thus, when the flap valve 10 is in its closing position to close the open end of the through-bore 3*b*, the flap vale 10 is in contact with only the valve seat 3*e*. Namely, the recess 3*f* of the rear plate 3 acts so as to reduce the contacting area between the flap valve 10 and a face portion surrounding the open end of the through-bore 3*b*.

As shown in FIG. 1, the front plate member 2 is provided with a plurality of circular fins 2*a* formed in a radially outer region of the front face thereof. The radially innermost fin 2*a* is formed as an integral portion with a central boss portion of the front plate member 2 which is in contact a portion of the inner face of the front housing body 1 via a sealing member 11 made of an O-ring. The fins 3*a* project frontward and cooperate with the inner wall surface of the front housing 1 to define a front heat receiving chamber FW arranged adjacent to a front portion of the heat generating chamber 8 to receive therein a later-described heat exchanging liquid which receives heat from the front portion of the heat generating chamber 8.

The rear plate member 3 is provided with a plurality of circular fins 3*g* formed in a radially outer region of the rear face thereof. The radially innermost circular fin 3*g* of the rear plate 3 is engaged with an inner boss portion formed in a radially middle portion of an inner surface of the rear housing body 4 via a sealing element 12 made of an O-ring. The circular fins 3*g* of the rear plate member 3 project rearward and cooperate with an inner wall surface of the rear housing body 4 to define a rear heat receiving chamber RW arranged adjacent to a rear portion of the heat generating chamber 8 to receive therein the heat exchanging liquid which receives heat from the rear portion of the heat generating chamber 8.

The radially innermost circular fin 3*g* of the rear plate member 3 and the inner boss of the rear housing body 4 cooperate with one another to define the afore-mentioned heat generation control chamber CR which fluidly communicates with the through-bore 3*a* (the fluid withdrawing passage), the through-bore 3*b* (the fluid supplying passage) and the through-bore 3*d* (FIGS. 1 and 2), i.e., the subsidiary fluid supplying passage.

The front plate member 2 is provided with an outer support rib 2*b* projecting frontward from an outer circumferential portion of the front plate member 2. The support rib 2*b* is formed as a circular wall portion in which a radial aperture 2*c* directly communicates with a later-described liquid inlet port 13 for heat exchanging liquid and a different radial aperture (not shown in FIG. 1) communicates with a liquid outlet port (not shown in FIG. 1) for the heat exchanging liquid.

The rear plate member 3 is provided with an outer support rib 3*h* formed as a circular wall portion in which a radial aperture 3*i* directly communicates with the liquid inlet port 13 and a different radial aperture (not shown in FIG. 1) communicates with the liquid outlet port are formed.

The front housing body 1 is provided with the above-mentioned liquid inlet port 13 and the liquid outlet port, which are arranged adjacent to one another in an outer circumference of the front housing body 1. The liquid inlet port permits introduction of the heat exchanging liquid from an external heating system into the front and rear heat receiving chambers FW and RW via the above-mentioned apertures 2*c,* and 3*i*. The liquid outlet port permits delivery of the heat exchanging liquid toward the external heating system from the front and rear heat receiving chambers FW and RW via the apertures of the front and rear plate members 2 and 3.

The front plate member 2 has the afore-mentioned central boss portion in which an anti-friction bearing 14 having therein a sealing element is accommodated, and the front housing body 1 has a central hollow boss portion in which an anti-friction bearing 15 is accommodated. These anti-friction bearings 14 and 15 rotatably support an axial drive shaft 16. The axial drive shaft 16 is arranged substantially horizontally, and has an inner end located in a region between the front and rear plate members 2 and 3. The drive shaft 16 supports thereon a rotor element 17 to rotate it within the heat generating chamber 18. The rotor element 17 is formed as a flat disk-like element keyed to the inner end of the drive shaft 16, and having flat opposite faces facing the front and rear inner wall surfaces of the heat generating chamber 8. The rotor element 17 is provided with a plurality of through-holes 17*a* formed in a radially inner region of the flat faces thereof so as to provide a fluid communication between the front and rear portions of the heat generating chamber 8.

The viscous fluid for heat generation is supplied into the gaps between the outer faces of the rotor element 17 and the inner wall surfaces of the heat generating chamber 8, and into the heat generation control chamber CR. The amount of the viscous fluid supplied into the heat generation control chamber CR is adjusted so that the through-bore 3*b* formed as the fluid supplying passage and the through-hole 3*d* formed as the subsidiary fluid supplying passage are constantly positioned below the fluid level of the viscous fluid within the heat generation control chamber CR. A small amount of air is contained in the heat generating chamber 8 and the heat generation control chamber CR which unavoidably enters the chambers 8 and CR during the assembly of the viscous fluid type heat generator.

An outer front end of the drive shaft 16 is provided with an axial threaded bore formed therein to be threadedly engaged with a pulley (not shown) which receives drive power from an external drive source, e.g., a vehicle engine, via a belt member (not shown in FIG. 1).

When the viscous fluid type heat generator is incorporated in a vehicle heating system, and when the drive shaft 16 is rotationally driven by the vehicle engine, the rotor element 17 is rotated within the heat generating chamber 8 to apply a shearing action to the viscous fluid, i.e., the silicone oil held between the inner wall surface of the heat generating chamber 8 and the outer faces of the rotor element 17. Thus, the silicone oil generates heat which is transmitted to the heat exchanging liquid flowing through the front and rear heat receiving chambers FW and RW. Therefore, the heat exchanging liquid carries the heat to the vehicle heating system which heats an objective area such as a passenger compartment.

When the temperature of the silicone oil within the heat generation control chamber CR becomes high due to an increase in the rotating speed of the vehicle engine, the supply of heat from the heat generator to the vehicle heating system becomes excessive. Therefore, the flap valve 9 closing and opening the fluid withdrawing passage (the through-bore 3*a*) is thermally deformed to open the through-bore 3*a,* and the flap valve 10 closing and opening the fluid supplying passage (the through-bore 3*b*) is also thermally deformed to close the through-bore 3*b* as illustrated in FIG. 3A. At this stage, it should be understood that, since the flap valves 9 and 10 are able to close and open the corresponding through-bores 3*a* and 3*b* due to their thermal deformation, the amount of the opening of the flap valves 9 and 10, i.e., the operating characteristics of the flap valves 9 and 10 can be minutely adjusted by adjustably changing the deformation properties of these flap valves 9 and 10 during the assembly of the viscous fluid type heat generator. As a result, the supply of the viscous fluid into the heat generating chamber from the heat generation control chamber and the withdrawal of the viscous fluid from the heat generating chamber into the heat generation control chamber can be optimumly controlled, and accordingly, the heat generation performance of the viscous fluid type heat generator can be set so as to optimumly comply with the heating requirements of the vehicle heating system.

Further, in the described embodiment, the flat plate-like flap valves 9 and 10 can be easily and fixedly attached to the rear plate member 3 by using only screw bolts 9*a* and 10*a,* the manufacturing and assembly of the flap valves 9 and 10 can be achieved with very low manufacturing costs. Further, the flap valves 9 and 10 can be small valve elements, respectively, and accordingly, the heat receiving chamber CR of the heat generator receiving therein the flap valves 9 and 20 can also be small. Therefore, the entire size of the viscous fluid type heat generator can be small, allowing the heat generator to be mounted in a relatively small mounting area such as the engine compartment of a vehicle.

The silicone oil in the heat generating chamber 8 has a fluid continuity with that in the heat generation control chamber CR via the opened through-bore 3*a* (the fluid withdrawing passage) due to the stretch viscosity of the silicone oil, and has no fluid continuity with that in the heat generation control chamber CR via the closed through-bore 3*b* (the fluid supplying passage). Accordingly, the silicone oil within the heat generating chamber 8 is withdrawn therefrom into the heat generation control chamber CR via the opened fluid withdrawing passage, and the supply of the silicone oil from the heat generation control chamber CR into the heat generating chamber 8 does not occur. A small amount of the silicone oil is, however, constantly supplied from the heat generation control chamber CR into the heat generating chamber 8 via the subsidiary through-bore 3*d* (the subsidiary fluid supplying passage). The silicone oil held between the front inner wall surface of the heat generating chamber 8 and the front outer face of the rotor element 17 is withdrawn into the heat generation control chamber CR by flowing through the through-holes 17*a* of the rotor element 17. Thus, as a result of the withdrawal of the silicone oil from the heat generating chamber 8 into the heat generation control chamber CR, heat generation by the silicone oil (the viscous fluid) held between the inner wall surfaces of the heat generating chamber 8 and the outer faces of the rotor element 17 is reduced to reduce the heat generation performance of the heat generator. Thus, the heating of the vehicle heating system becomes weak. When the reduction in the heat generation performance of the heat generator occurs, degradation of the silicone oil can be prevented even if the drive shaft 16 maintains its high speed rotation.

When the temperature of the silicone oil within the heat generation control chamber CR is kept low, the heat generation by the silicone oil of the heat generating chamber 8 is excessively small. Thus, the flap valve 9 for the fluid withdrawing passage is thermally deformed to close the throughbore 3*a,* and the flap valve 10 is deformed so as to open the through-bore 3*b* of the fluid supplying passage as shown in FIG. 3B. At this stage of opening of the flap valve 10, since the flap valve 10 is in contact with the small valve seat 3*e* due to the existence of the circular recess 3*f,* the flap valve 10 can be easily separated from a contacting face portion around the through-bore 3*b* to open the through-bore 3*b* against the surface tension of the silicone oil acting between the flap valve 10 and the small valve seat 3*e* around the through-bore 3*b* functioning as the fluid supplying passage. Namely, since the small valve seat 3*e* and the circular recess 3*f* act as a valve action correcting arrangement to promote separation of the flap valve 10 from the contacting face portion of the rear plate member 3, the through-bore 3*b* functioning as the fluid supplying passage can be immediately opened when it is to be opened. Thus, the silicone oil within the heat generating chamber 8 has a fluid continuity with that within the heat generation control chamber CR through the opened fluid supplying passage, i.e., the opened through-bore 3*b* due to the stretch viscosity of the silicone oil. On the other hand, the fluid continuity of the silicone oil between the heat generating chamber 8 and the heat generation control chamber CR is cut by the closing of the through-bore 3*a* of the fluid supplying passage. Therefore, the silicone oil is supplied from the heat generation control chamber CR into the heat generating chamber 8 via the fluid supplying passage without withdrawing the silicone oil from the heat generating chamber 8 into the heat generation control chamber CR via the fluid withdrawing passage. The silicone oil supplied into the heat generating chamber 8 is distributed into gaps between the front inner wall surface of the heat generating chamber 8 and the front outer surface of the rotor element 17 through the through-hole 17*a* of the rotor element 17. Thus, heat generation by the silicone oil held between the inner wall surfaces of the heat generating chamber 8 and the outer faces of the rotor element 17 is increased. Namely, the heat generation performance of the viscous fluid type heat generator is increased to supply the vehicle heating system with an increased amount of heat.

From the foregoing description of the first embodiment of the present invention, it will be easily understood that the viscous fluid type heat generator of the first embodiment can change its heat generation performance immediately in response to a change in the heating requirements of the heating system such as the vehicle heating system. Further, the subsidiary through-bore 3*d,* i.e., the subsidiary fluid supplying passage extending between the heat generating chamber 8 and the heat generation control chamber CR constantly provides a fluid communication between both chambers 8 and CR, and therefore, a small amount of silicone oil is constantly supplied from the heat generation control chamber CR into the heat generating chamber 8. Accordingly, the silicone oil in the heat generating chamber 8 is made to gradually circulate through both chambers 8 and CR, and accordingly, replacement of the silicone oil in the heat generating chamber 8 with the silicone oil supplied from the heat generation control chamber CR occurs so as to suppress degradation of the silicone oil, i.e., the viscous fluid, due to the overheating. Thus, even after the high speed operation of the viscous fluid type heat generator, the heat generation performance of the heat generator can be surely maintained at the high level necessary for working as a heat source for a vehicle heating system.

Further, the flap valves 9 and 10 made of a relatively thin bimetallic flat material can contribute to not only good response characteristics of the valves for the fluid supplying and fluid withdrawing passages with respect to a change in the temperature of the viscous fluid within the heat generation control chamber CR but also to production of a viscous fluid type heat generator light in weight and low in manufacturing costs.

Moreover, in the described embodiment of the present invention, when the temperature of the viscous fluid (the silicone oil) within the heat generating and heat generation control chambers becomes low, the heat generator can restore its high heat generation performance by itself without application of an external signal to the heat generator from outside. Therefore, the heating system including the viscous fluid type heat generator of the present invention can be a low-manufacturing-cost type heating system.

Further, in the above-described heat generator, during the withdrawing of the viscous fluid from the heat generating chamber 8 into the heat generation control chamber CR, and during the supply of the viscous fluid from the heat generation control chamber CR into the heat generating chamber 8, the total inner volume of the heat generating chamber 8, the through-bore 3*a* (the fluid withdrawing passage), the through-bore 3*b* (the fluid supplying passage), the through-hole 3*d* (the subsidiary fluid supplying passage), and the heat generation control chamber CR are not changed. Thus, the movement of the viscous fluid (the silicone oil) does not generate a vacuum in the heat generator. Thus, the viscous fluid does not come into contact with fresh external air or any moisture. Therefore, degradation of the heat generating characteristics of the viscous fluid does not occur.

In the described viscous fluid type heat generator according to the first embodiment, even if the drive shaft 16 is continuously rotated at a high speed, the afore-mentioned replacement of the viscous fluid (the silicone oil) in the heat generating chamber with that in the heat generation control chamber CR constantly occurs. Therefore, the viscous fluid is not subjected to overheating by which the heat generating characteristics of the viscous fluid is degraded. This fact, of course, ensures a high level heat generation performance of the viscous fluid type heat generator after continuous high speed operation of the heat generator.

Figure 4:
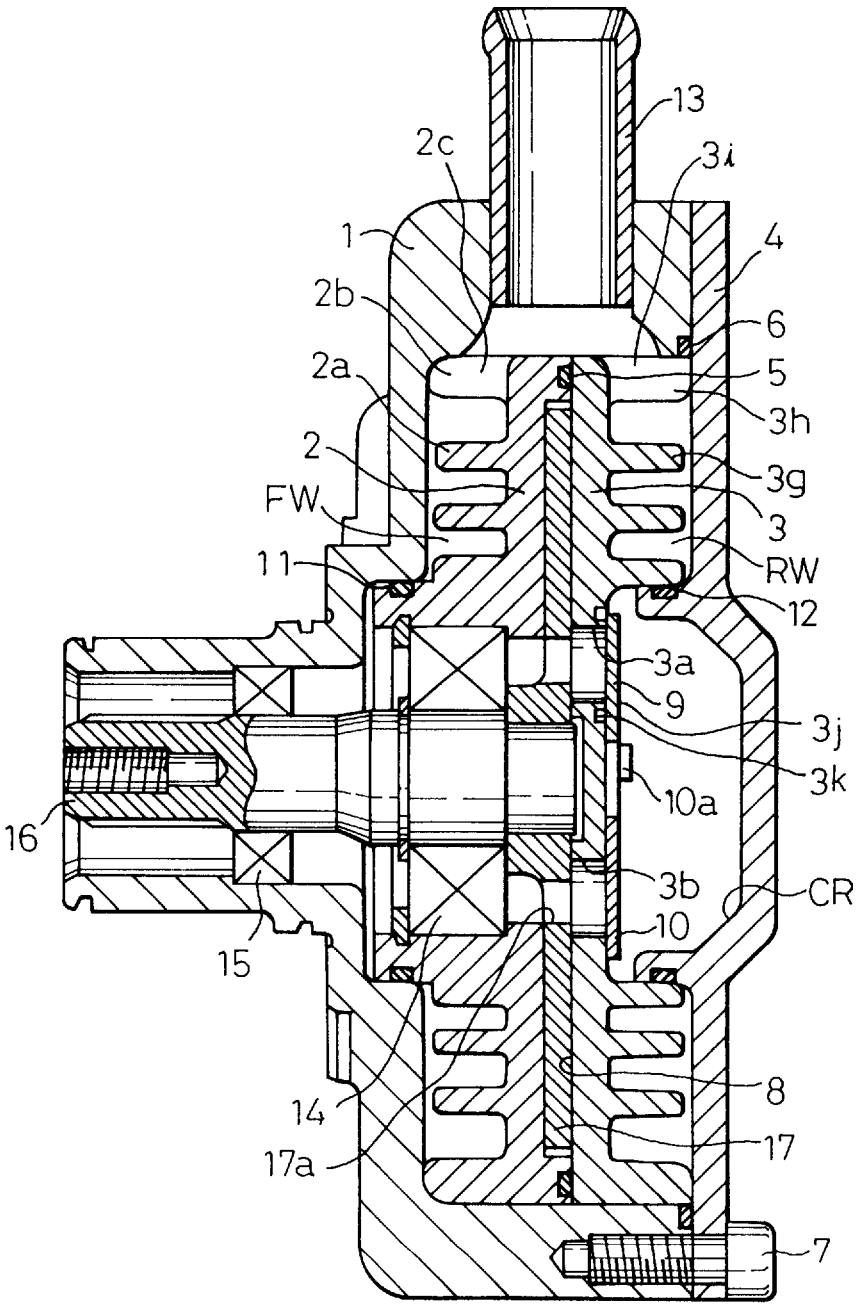
FIG. 4 is a cross-sectional view of a variable heat generation performance, viscous fluid type heat generator according to another embodiment of the present invention.
Figure 5:
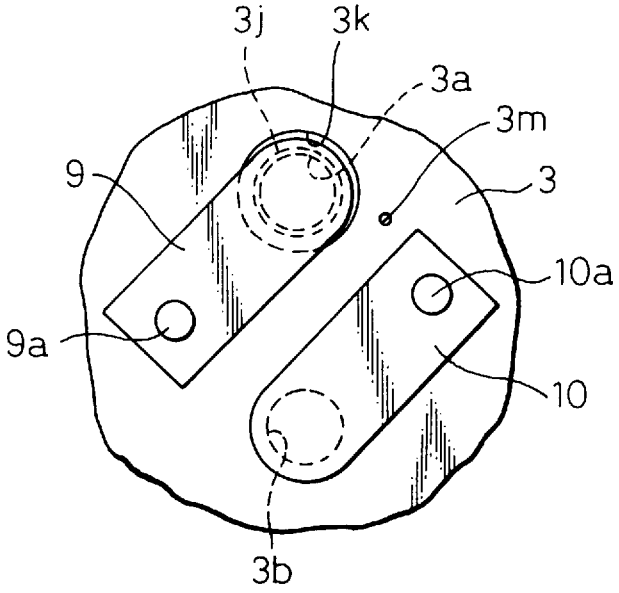
FIG. 5 is a partial view of a rear plate member incorporated in the heat generator of FIG. 4, illustrating an arrangement of flap valves, viewed from the heat generating control chamber of the heat generator.

FIGS. 4 and 5 illustrate a variable heat generation performance, viscous fluid type heat generator according to the second embodiment of the present invention, in which the same reference numerals as those of the first embodiment of FIGS. 1 through 3B designate the same or like elements as the elements of the first embodiment.

The viscous fluid type heat generator of the second embodiment is different from that of the first embodiment in that the flap valve 9 opening and closing the through-bore 3*a* functioning as a fluid withdrawing passage comes into contact with a circular valve seat 3*j* formed around the through-bore 3*a* of the rear plate member 3 and enclosed by a substantially circularly extending recess 3*k* recessed in the rear plate member 3. The circular recess 3*k* acts so as to reduce the contact area between the flap valve 9 and a face portion of the rear plate member 3 around the through-bore 3*a*. Thus, the surface tension of the viscous fluid acting between the flap valve 9 and the face portion is reduced to improve the valve operation of the flap valve 9.

The heat generator of the second embodiment is further different from the first embodiment in that a subsidiary fluid withdrawing passage in the form of a small through-hole 3*m* is arranged at a position close to the through-bore 3*a* acting as fluid withdrawing passage. Further, the heat generator of the second embodiment is not provided with a subsidiary fluid supply passage.

In the viscous fluid type heat generator of the second embodiment, when heat generation by the silicone oil in the heat generating chamber 8 is increased until the temperature of the silicone oil held within the heat generation control chamber CR becomes excessively high, the flap valve 9 opening and closing the through-bore 3*a* of the fluid withdrawing passage is thermally deformed to open the through-bore 3*a,* and simultaneously the flap valve 10 is thermally deformed to close the through-bore 3*b* of the fluid supplying passage. The opening of the flap valve 9 quickly occurs at a desired temperature of the silicone oil by easily overcoming a small surface tension of the silicone oil appearing between the small valve seat 3*j* enclosed by the circular recess 3*k* and the flap valve 9 per se. Namely, the small valve seat 3*j* and the circular recess 3*k* act as a valve action correcting arrangement for promoting the separation of the flap valve 9 from the valve seat 3*j*. Therefore, the withdrawing of the silicone oil from the heat generating chamber 8 into the heat generation control chamber CR quickly occurs to reduce heat generation by the silicone oil held within the heat generating chamber 8.

Further, the provision of the small through-bore 3*m* functioning as a subsidiary fluid withdrawing passage between the heat generating chamber 8 and the heat generation control chamber CR contributes to promoting a gradual circulatory flow of the silicone oil through both chambers 8 and CR. Therefore, the silicone oil in the heat generating chamber 8 can be replaced with the silicone oil in the heat generation control chamber CR during the operation of the heat generator. Thus, the silicone oil in the heat generating chamber 8 is not subjected to overheating which might cause degradation of the heat generating property of the silicone oil. Further, even after continuous high speed operation of the heat generator, the viscous fluid type heat generator of the second embodiment can surely exhibit an ordinary heat generation performance.

It should be understood that the thermally deformable flap valve 9 for opening and closing the through-bore 3*b* of the fluid withdrawing passage may be replaced with a reed type flap valve able to open and close the through-bore 3*b* in response to a change in the fluid pressure of the silicone oil held in both heat generating chamber 8 and heat generation control chamber CR.

Figure 6:
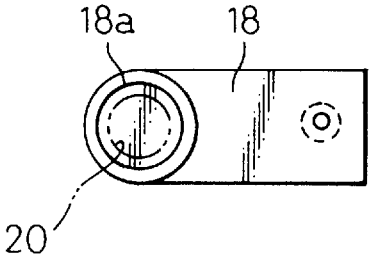
FIG. 6 is a partial plan view of a modified flap valve, illustrating the construction of a contacting portion of the flap valve.
Figure 7:
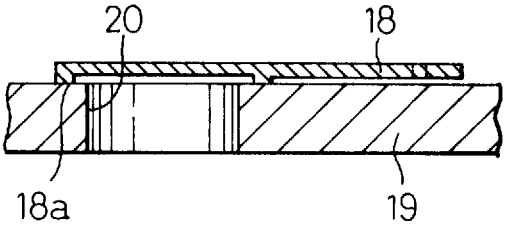
FIG. 7 is a cross-sectional view of the modified flap valve of FIG. 6, and a rear plate to which the flap valve is attached, illustrating the closing position of the modified flap valve.

FIGS. 6 and 7 illustrate a modified flap valve capable of being accommodated in a variable heat generation performance, viscous fluid type heat generator.

As shown in FIG. 6, a modified flap valve 18 is provided with an inner base face portion in which a circular projection-like valve seat 18*a* is formed. The modified flap valve 18 is attached to a rear plate member 19 by a suitable fixing means such as a screw so as to close a through-bore 20 formed in the rear plate member 19 as a fluid supplying passage as clearly shown in FIG. 7. Namely, the circular valve seat 18*a* of the modified flap valve 18 closes the through-bore 20 when the valve seat 18*a* is in contact with a flat face portion of the rear plate member 19 around the through-bore 20.

It should be understood that the heat generator accommodating therein the modified flap valve 18 and the rear plate member 19 has the same internal construction as that of the heat generator of the first embodiment except for the construction of the flap valve 18 and the rear plate member 19. Therefore, the heat generator of FIGS. 6 and 7 can exhibit the same quick response characteristics in controlling of the heat generation performance thereof as those of the heat generator of the first embodiment while preventing degradation of the heat generating property of the viscous fluid for a long operation life of the heat generator and even after a continuous high speed operation of the heat generator.

It should further be understood that the construction of the modified flap valve 18 cooperating with the flat face portion around the through-bore 20 of the rear plate member 19 may be similarly applicable to a flap valve for opening and closing a through-bore of a fluid withdrawing passage formed in the rear plate member 19 and having a flat face portion surrounding the through-bore.

Figure 8:
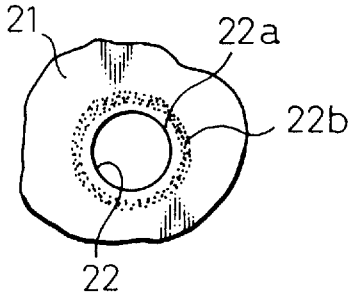
FIG. 8 is a partial plan view of a rear plate able to be accommodated in a variable heat-generation-performance, viscous-fluid-type heat generator, illustrating a roughened surface arranged around the open end of a fluid supplying passage.
Figure 9:
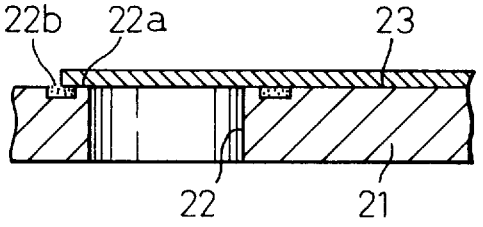
FIG. 9 is a cross-sectional view of a flap valve and the rear plate of FIG. 8, illustrating the closing position of the flap valve with respect to the open end of the fluid supplying passage; and, FIG. 10 is a cross-sectional view of a flap valve and a rear plate to which the flap valve is attached, illustrating the closing position of the flap valve.

FIGS. 8 and 9 illustrate a modified variable heat generation performance, viscous fluid type heat generator. In the heat generator of FIGS. 8 and 9, a rear plate member 21 is provided with a through-bore 22 functioning as a fluid supplying passage. The through-bore 22 is formed so as to have a circular valve seat portion 22*a* enclosed by a circular surface-roughened portion 22*b*. The heat generator is also provided with a flap valve 23 formed as a flat thin deformable valve having a flat contacting portion coming into contact with the small circular valve seat portion 22*a* and the surface-roughened portion 22*b*. The surface-roughened portion 22*b* around the through-bore 22 prevents the flap valve 23 from tightly coming into contact with the flat face of the flap valve 23. Therefore, the flap valve 23 can open the through-bore 22 while overcoming the surface tension of the viscous fluid acting between the small circular valve seat portion 22*a* and the flap valve 23.

It should be understood that the heat generator accommodating therein the flap valve 23 and the rear plate member 21 has the same internal construction as that of the heat generator of the first embodiment except for the constructions of the flap valve 23 and the rear plate member 21 having the through-bore 22 enclosed by the small circular valve seat 22*a* and the circular surface-roughened portion 22*b*.

It should further be understood that the construction of the flat flap valve 23 cooperating with the through-bore 22 (the fluid supplying passage) of the rear plate member 21 enclosed by the small circular valve seat 22*a* and the surface-roughened portion 22*b* may be similarly applicable to a flap valve for opening and closing a fluid withdrawing passage formed in the rear plate member 21.

Figure 10:
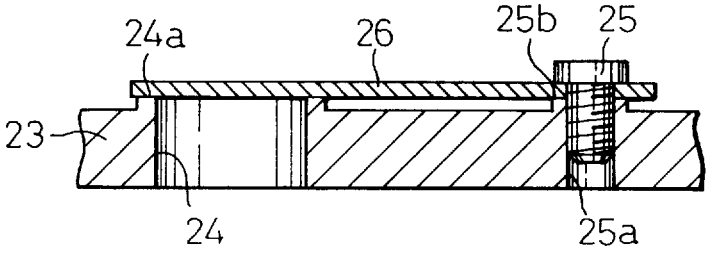

FIG. 10 illustrates a further modified variable heat generation performance, viscous fluid type heat generator of the present invention.

As clearly shown in FIG. 10, the heat generator is provided with a rear plate member 23 provided with a through-bore 24 functioning as a fluid supplying passage. The through-bore 24 is enclosed by a substantially circular projection-like valve seat portion 24*a*. The rear plate member 23 is further provided with a threaded bore 25*a* enclosed by a circular projection-like seat 25*b* for a screw bolt 25 fixing a flat plate-like flap valve 26 to the rear plate member 23. The flap valve 26 opens and closes the fluid supplying passage (the through-bore 24) by the deformation the valve per se. The circular valve seat 24*a* of the rear plate member 23 can reduce a contacting area of the flap valve 26, and accordingly, the flap valve 26 can quickly open the through-bore 24 (the fluid supplying passage) by easily overcoming the surface tension of the viscous fluid attached to the small circular valve seat portion 24*a*.

It should be understood that the heat generator accommodating therein the flat flap valve 26 and the rear plate member 23 has the same internal construction as that of the heat generator of the first embodiment except for the construction of the flap valve 26 and the rear plate member 23 having the through-bore 24 enclosed by the small circular projection-like valve seat 24*a* and the circular projection-like seat 25*b* for the screw bolt 25.

It should further be understood that the construction of the flat flap valve 26 cooperating with the through-bore 24 (the fluid supplying passage) of the rear plate member 23 enclosed by the small circular projection-like valve seat 24*a* may be similarly applicable to a flap valve for opening and closing a fluid withdrawing passage formed in the rear plate member 21.

From the foregoing description of the preferred embodiments of the present invention, it will be understood that, according to the present invention the variable heat generation performance, viscous fluid type heat generator can exhibit quick response characteristics in controlling the heat generation performance thereof in response to the heating requirements of a heating system in which the heat generator is incorporated. The heat generator also has the ability to prevent the viscous fluid confined therein from being degraded even after long use of the heat generator, and even after continuous high speed operation of the heat generator.

It should further be understood that many modifications and variations of the viscous fluid type heat generator will occur to persons skilled in the art without departing from the scope and spirit of the present invention as claimed in the accompanying claims.

We claim:

1. A variable heat-generation-performance, viscous-fluid-type heat generator comprising:

a housing assembly defining therein a heat generating chamber in which heat is generated, and a heat receiving chamber arranged adjacent to said fluid-tight heat generating chamber to permit a heat exchanging fluid to circulate therethrough to thereby receive heat from said heat generating chamber, said heat generating chamber having inner wall surfaces thereof;

a drive shaft supported by said housing assembly to be rotatable about an axis of rotation thereof, said drive shaft being operatively connected to an external rotation-drive source;

a rotor element mounted to be rotationally driven by said drive shaft for rotation together therewith within said heat generating chamber, said rotor element having outer faces confronting said inner wall surfaces of said heat generating chamber via a predetermined gap;

a viscous fluid, filling said predetermined gap between said inner wall surfaces of said heat generating chamber and said outer faces of said rotor element, for heat generation during the rotation of said rotor element, wherein said housing assembly further comprises:

a heat generation control chamber formed therein to have a given amount of volume for containing the viscous fluid therein;

a fluid withdrawing passage for passing the viscous fluid from said heat generating chamber toward said heat generation control chamber to permit at least a part of the viscous fluid in said heat generating chamber to be withdrawn into said heat generation control chamber for reducing a heat generation performance of the viscous fluid type heat generator, said fluid withdrawing passage having opposite open ends thereof;

a fluid supplying passage for passing the viscous fluid from said heat generation control chamber toward said heat generating chamber to permit at least a part of the viscous fluid in said heat generation control chamber to be supplied into said heat generating chamber for increasing the heat generation performance of said viscous fluid type heat generator, said fluid supplying passage having opposite open ends;

a flap valve means for closing one of said opposite open ends of at least one of said fluid withdrawing and supplying passages, said flap valve means being arranged to be in contact with a face portion of said housing assembly extending around one of said opposite open ends of at least one of said fluid withdrawing and supplying passages when said flap valve means is in a closing position thereof, and being deformable to make a self-movement thereof moving from the closing position thereof; and, a valve action correcting means for promoting a separation of the flap valve means from said face portion of said housing assembly extending around one of said opposite open ends of at least one of said fluid withdrawing and supplying passages when said flap valve means moves from the closing position thereof.

2. A variable heat-generation-performance, viscous-fluid-type heat generator according to claim 1, wherein said valve action correcting means comprises a contacting area reducing construction arranged between said face portion of said housing assembly extending around one of said opposite open ends of at least one of said fluid withdrawing and supplying passages and said flap valve means so as to reduce a contact area of said flap valve means with said face portion of said housing assembly.

3. A variable heat-generation-performance, viscous-fluid-type heat generator according to claim 2, wherein said contacting area reducing construction comprises a circularly extending recess formed in said face portion of said housing assembly to arrange a substantially circular valve seat surrounding said open end of at least one of said fluid withdrawing and supplying passages, which is closed and opened by said flap valve means, said circularly extending recess being arranged to not be in contact with said flap valve means when said flap valve means is in its closing position.

4. A variable heat-generation-performance, viscous-fluid-type heat generator according to claim 3, wherein said circular valve seat of said housing assembly of said viscous fluid type heat generator incorporated in a vehicle heating system is formed to have a width of 0.2 mm through 1.0 mm.

5. A variable heat-generation-performance, viscous-fluid-type heat generator according to claim 3, wherein said circular recess is formed in said face portion of said housing assembly to be equal to or larger than 0.05 mm deep to thereby effectively reduce the surface tension of the viscous fluid.

6. A variable heat-generation-performance, viscous-fluid-type heat generator according to claim 2, wherein said contacting area reducing construction comprises a substantially circular valve seat formed by a circularly extending raised portion arranged in said face portion of said housing assembly.

7. A variable heat-generation-performance, viscous-fluid-type heat generator according to claim 6, wherein said circularly extending raised portion of said contacting area reducing construction is formed in a portion of said flap valve means per se so that only said raised portion of said flap valve means comes into contact with a flat face portion of said housing assembly to close said open end of either said fluid supplying passage or said fluid withdrawing passage.

8. A variable heat-generation-performance, viscous-fluid-type heat generator according to claim 2, wherein said contacting area reducing construction of said valve action correcting arrangement comprises a substantially circular valve seat surrounding said open end of at least one of said fluid withdrawing and supplying passages, and a substantially circular surface-roughened area extending around said circular valve seat, said circular valve seat and said circular surface-roughened area being formed in said face portion of said housing assembly.

9. A variable heat-generation-performance, viscous-fluid-type heat generator according to claim 1, further comprising a subsidiary fluid supplying passage for providing a predetermined constant fluid communication between said heat generation control chamber and said heat generating chamber, said subsidiary fluid supplying passage constantly supplying a given amount of viscous fluid from said heat generation control chamber to said heat generating chamber.

10. A variable heat-generation-performance, viscous-fluid-type heat generator according to claim 1, further comprising a subsidiary fluid withdrawing passage for providing a predetermined constant fluid communication between said heat generation control chamber and said heat generating chamber, said subsidiary fluid withdrawing passage constantly withdrawing a given amount of the viscous fluid from said heat generating chamber to said heat generation control chamber.

* * * * *